US008919922B2

(12) United States Patent
Hayashi

(10) Patent No.: US 8,919,922 B2
(45) Date of Patent: Dec. 30, 2014

(54) WASHING LIQUID SUPPLY MECHANISM AND INKJET PRINTER

(71) Applicant: Roland DG Corporation, Hamamatsu-shi, Shizuoka (JP)

(72) Inventor: Hiroyuki Hayashi, Hamamatsu (JP)

(73) Assignee: Roland DG Corporation, Shizuoka (JP)

( * ) Notice: Subject to any disclaimer, the term of this patent is extended or adjusted under 35 U.S.C. 154(b) by 0 days.

(21) Appl. No.: 14/184,828

(22) Filed: Feb. 20, 2014

(65) Prior Publication Data

US 2014/0240394 A1 Aug. 28, 2014

(30) Foreign Application Priority Data

Feb. 22, 2013 (JP) ..... 2013-032707

(51) Int. Cl.
*B41J 2/015* (2006.01)
*B41J 2/165* (2006.01)

(52) U.S. Cl.
CPC ..... *B41J 2/1652* (2013.01); *B41J 2/16523* (2013.01)
USPC ..... 347/33; 347/21; 347/29

(58) Field of Classification Search
USPC ..... 347/21, 29, 33
See application file for complete search history.

(56) References Cited

U.S. PATENT DOCUMENTS

| | | | | |
|---|---|---|---|---|
| 5,300,958 | A * | 4/1994 | Burke et al. | 347/28 |
| 5,589,861 | A * | 12/1996 | Shibata | 347/22 |
| 6,659,586 | B2 * | 12/2003 | Balcan et al. | 347/32 |
| 8,123,329 | B2 * | 2/2012 | Yahiro | 347/21 |

* cited by examiner

*Primary Examiner* — Jason Uhlenhake
(74) *Attorney, Agent, or Firm* — Keating & Bennett, LLP

(57) ABSTRACT

A washing liquid supply mechanism includes a washing liquid supply device including a supply opening that supplies a washing liquid, the washing liquid supply device being mounted on a carriage; an openable/closable shutter mounted on the carriage and connected to the supply opening of the washing liquid supply device; and a shutter open/close device that opens the shutter when the carriage moves from a first position at which printing is performed to a second position at which printing is not performed and that closes the shutter when the carriage moves from the second position to the first position.

9 Claims, 5 Drawing Sheets

WASHING LIQUID SUPPLY MECHANISM AND INKJET PRINTER

The present application claims priority from Japanese Patent Application No. 2013-032707 filed on Feb. 22, 2013, which is incorporated by reference herein in its entirety.

BACKGROUND OF THE INVENTION

1. Field of the Invention

The present invention relates to a washing liquid supply mechanism and an inkjet printer including the same.

2. Description of the Related Art

Conventionally, inkjet printers for performing printing by an inkjet method are known. Such an inkjet printer, for example, has an overall operation thereof controlled by a microcomputer and performs printing on a recording paper sheet supplied from a paper feeding device. The inkjet printer includes an ink head for ejecting ink. The ink head is structured to move above the recording paper sheet in a width direction of the recording paper sheet. In this specification, the width direction of a medium such as a recording paper sheet or the like will be referred to as a "main scanning direction". A direction perpendicular to the main scanning direction will be referred to as a "sub scanning direction". The ink head has a plurality of inkjet nozzles formed therein. An inkjet nozzle is an ejection orifice for ejecting ink toward the recording paper sheet.

The inkjet printer includes a cleaning unit for cleaning the ink head. The cleaning unit includes, for example, a cap for capping a portion of the ink head that has the inkjet nozzles formed therein and a wiper for wiping a bottom surface of the ink head.

The cap protects the inkjet nozzles. The cap also recovers the ejected ink in order to solve the problem that the inkjet nozzles are clogged. The ink recovered by the cap is discharged to a waste liquid tank or the like connected to the cap. The cap is washed with a washing liquid periodically supplied thereto. The inkjet printer includes a washing liquid supply mechanism for supplying the washing liquid to the cap. After being used, the washing liquid is discharged to the waste liquid tank.

The wiper wipes the bottom surface of the ink head to remove substances attached to the bottom surface thereof. The substances removed from the ink head are attached to the wiper. The wiper is immersed in a washing liquid tub and washed with a washing liquid stored therein. When the amount of the washing liquid in the washing liquid tub is decreased, the washing liquid tub is replenished with the washing liquid so that the amount of the washing liquid in the washing liquid tub is kept constant. For supplying the washing liquid to the washing liquid tub, the inkjet printer includes another washing liquid supply mechanism.

Thus, the conventional inkjet printer needs to have two washing liquid supply mechanisms for supplying a washing liquid.

SUMMARY OF THE INVENTION

If one washing liquid supply mechanism having the functions of these two washing liquid supply mechanisms is provided, the space required for the washing liquid supply mechanism is decreased and thus the size of the inkjet printer is reduced. Specially, if a washing liquid supply mechanism capable of supplying a washing liquid to the cap and also supplying a washing liquid for washing the wiper to the washing liquid tub for storing the washing liquid is provided, an inkjet printer having a reduced size is realized.

Accordingly, preferred embodiments of the present invention provide a washing liquid supply mechanism capable of supplying a washing liquid to a cap and also supplying the washing liquid to wash a wiper to a washing liquid tub that stores the washing liquid, and an inkjet printer including the same.

A washing liquid supply mechanism according to a preferred embodiment of the present invention is provided in an inkjet printer. The inkjet printer includes a carriage reciprocally movable in a main scanning direction between a first position at which printing is performed and a second position at which printing is not performed; an ink head including a bottom surface on which a inkjet nozzle is provided, the ink head being mounted on the carriage; a cap structured to fit below the ink head when the carriage is at the second position to protect the ink head nozzle; a wiper structured to fit below the ink head when the carriage is at the second position to wipe the bottom surface of the ink head; and a washing liquid tub that stores a washing liquid usable to wash the wiper and is located below the wiper. The washing liquid supply mechanism is a mechanism that supplies the washing liquid to the cap and the washing liquid tub. The washing liquid supply mechanism includes a washing liquid supply device includes a supply opening to supply the washing liquid, the washing liquid supply device being mounted on the carriage; an openable/closable shutter mounted on the carriage and connected to the supply opening of the washing liquid supply device; and a shutter open/close device that opens the shutter when the carriage moves from the first position to the second position and closes the shutter when the carriage moves from the second position to the first position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the attached drawings.

In this specification, the term "medium" encompasses various types of recording mediums formed of plain paper and other types of paper and also recording mediums formed of various types of materials including PVC, resin materials such as polyester and the like, and other materials including aluminum, iron, wood and the like.

In this specification, the term "inkjet method" refers to any of various, conventionally known printing methods using inkjet technology that include various continuous methods such as a binary deflection method and a continuous deflection method and various on-demand methods such as a thermal method and a piezoelectric element method.

Figure 1:
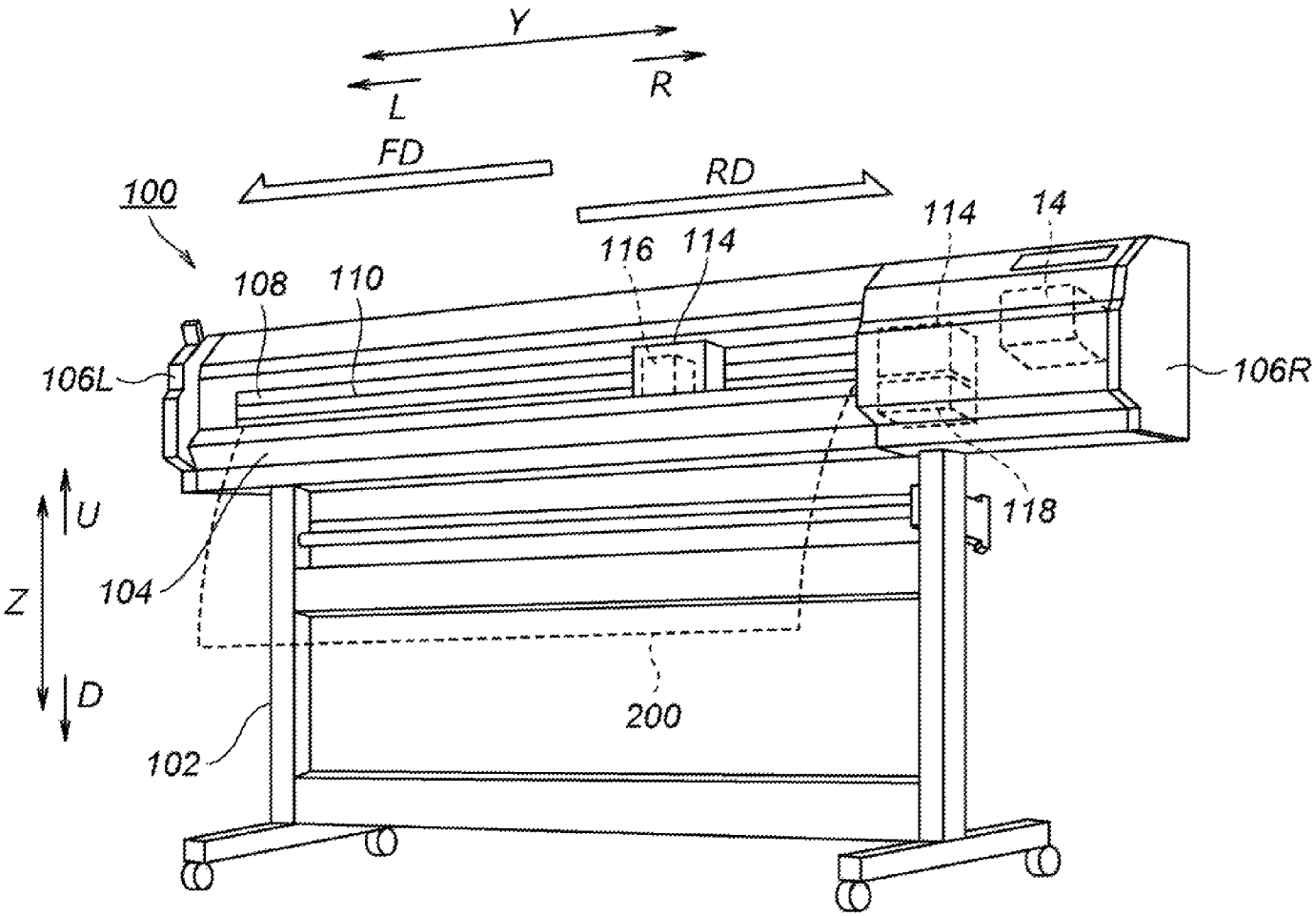
FIG. 1 is an isometric view of an inkjet printer.

FIG. 1 is an isometric view showing a schematic structure of an inkjet printer 100. In the following description, the terms "left", "right", "up" and "down" respectively mean left, right, up and down as seen from a user who is facing the inkjet printer 100 in front thereof. A direction approaching the user from the inkjet printer 100 is defined as "forward", and a direction moving away from the user toward the inkjet printer 100 is defined as "rearward". In the figures, reference signs F, Re, L, R, U and D respectively represent forward, rearward, leftward, rightward, upward and downward. In the figures, reference sign Y represents a main scanning direction. In this preferred embodiment, the main scanning direction Y is the left-right direction. Reference sign X represents a sub scanning direction. The sub scanning direction is perpendicular to the main scanning direction. In this preferred embodiment, the sub scanning direction X is the front-rear direction. Reference sign Z represents the up-down direction. It should be noted that the above-described directions are defined for the sake of convenience and should not be interpreted as limiting the present invention.

For the inkjet printer 100, a recording paper sheet 200 is used as the medium. The medium is not limited to the recording paper sheet 200. The main scanning direction Y corresponds to a width direction of the recording paper sheet 200. The recording paper sheet 200 is fed in a direction perpendicular to the main scanning direction Y (namely, in the sub scanning direction X) by a paper feeding device (not shown); in other words, the recording paper sheet 200 is fed in a longitudinal direction thereof.

The inkjet printer 100 includes a base member 104, side members 106L and 106R, a central wall 108, a guide rail 110, a belt (not shown), a carriage 114, an ink head section 116, and a cleaning unit 118.

The base member 104 extends in the main scanning direction Y and is supported by a support member 102. Although not shown, the base member 104 includes a platen provided therein to support the recording paper sheet 200. The left side member 106L is provided at a left end of the base member 104. The right side member 106R is provided at a right end of the base member 104. The side members 106L and 106R extend perpendicularly to the base member 104. The central wall 108 extends in the main scanning direction Y and couples the left side member 106L and the right side member 106R to each other. The guide rail 110 is located on a wall surface of the central wall 108, and extends in the main scanning direction Y. The guide rail 110 is an example of a rail member. The belt is located parallel to the wall surface of the central wall 108 and extends in the main scanning direction Y. The carriage 114 is slidably mounted on the guide rail 110, and is fixed to the belt. When the belt runs, the carriage 114 moves in the main scanning direction Y along the guide rail 110. The carriage 114 is movable leftward and rightward.

The recording paper sheet 200, which is a medium, is located on the base member 104. Although not shown, the inject printer 100 includes a paper feeding roll around which the recording paper sheet 200 is to be wound and a paper feeding device to move the recording paper sheet 200. The recording paper sheet 200 is fed onto the base member 104 from the paper feeding roll by the paper feeding device. The recording paper sheet 200 is fed in the sub scanning direction X. For example, at the time of printing, the recording paper sheet 200 is fed forward. The ink head section 116 is located in the carriage 114 and faces the recording paper sheet 200. As described later, the cleaning unit 118 is structured to be movable in the sub scanning direction X. The cleaning unit 118 is located in the right side member 106R. Alternatively, the cleaning unit 118 may be located in the left side member 106L. The overall operation of the inkjet printer 100 is controlled by a microcomputer (not shown).

Figure 4A:
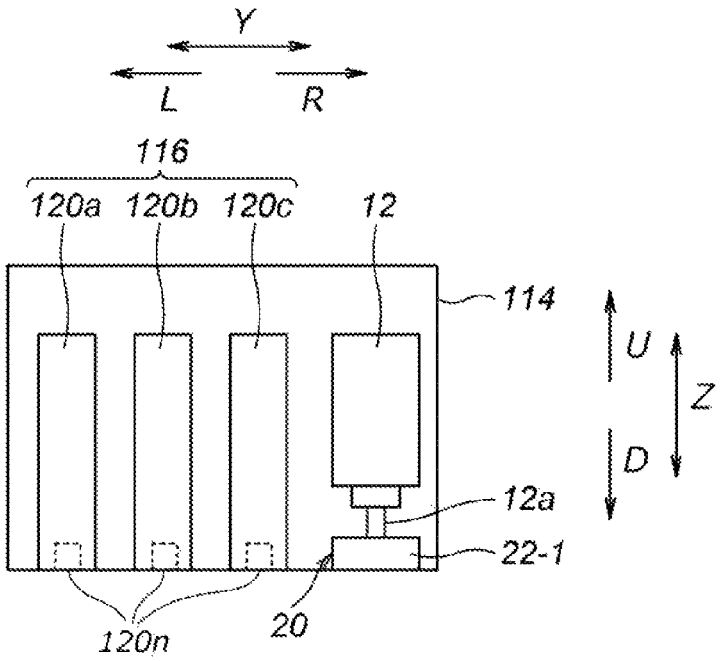
FIG. 4*a* shows a structure of a carriage including an ink head, a washing liquid supply unit and a shutter.

The ink head section 116 is structured to eject liquid ink toward the recording paper sheet 200 by an inkjet method. As shown in FIG. 4*a*, the carriage 114 includes three independent ink heads 120*a*, 120*b* and 120*c* mounted thereon, which are included in the ink head section 116. The carriage 114 also includes a washing liquid supply unit 12 mounted thereon adjacent to the ink heads 120*a*, 120*b* and 120*c*. The washing liquid supply unit 12 is an example of a washing liquid supply device. The washing liquid supply unit 12 is structured to supply a washing liquid stored in a washing liquid tank 14 (see FIG. 1) to the cleaning unit 118. The washing liquid may be a liquid capable of dissolving ink, such as water, an organic solvent or the like.

The ink heads 120*a*, 120*b* and 120*c* each include an inkjet nozzle 120*n* provided on a bottom surface thereof. The inkjet nozzles 120*n* are ejection orifices to eject ink toward the recording paper sheet 200, and are located to face the recording paper sheet 200. The inkjet nozzles 120*n* are located side by side in the sub scanning direction X. Bottom portions of the inkjet heads 120*a*, 120*b* and 120*c* may protrude downward from an opening (not shown) located at a bottom surface of the carriage 114, and the inkjet nozzles 120*n* may be located outside the carriage 114. The inkjet heads 120*a*, 120*b* and 120*c* are each connected to an ink cartridge (not shown) via a tube (not shown). The ink cartridges accommodate ink of different colors. Ink is sent from the ink cartridges to the ink heads 120*a*, 120*b* and 120*c* and is ejected from the inkjet nozzles 120*n* toward the recording paper sheet 200.

As described above, the carriage 114 is fixed to the belt. When the belt is driven by a motor (not shown) to run, the carriage 114 moves in the main scanning direction Y along the central wall 108. When the carriage 114 moves in this manner, the ink heads 120*a*, 120*b* and 120*c* and the washing liquid supply unit 12 mounted on the carriage 114 move in the main scanning direction Y above the recording paper sheet 200. In this example, as shown in FIG. 1, a direction from the side member 106R accommodating the cleaning unit 118 toward the side member 106L not accommodating the cleaning unit 118, namely, the leftward direction will be referred to as a "forth direction FD". A direction from the side member 106L toward the side member 106R, namely, the rightward direction will be referred to as a "return direction RD". The ink heads 120*a*, 120*b* and 120*c* and the washing liquid supply unit 12 are structured to be movable in the forth direction RD and the return direction RD.

In the inkjet printer 100, the carriage 114 and the ink head section 116 are movable between two positions, namely, a position at which printing is performed (hereinafter, referred to as a "printing position") and a wait position. Herein, the term "position" does not refer to one particular position but refers to an area having a certain length. The printing position is a position where printing is performed on the recording paper sheet 200, and is above the recording paper sheet 200. The wait position is to the right of the printing position, and is in the side member 106R. The wait position may be to the left of the printing position, and may be in the side member 106L. The wait position is not limited to any particular position. When the carriage 114 and the ink head section 116 are at the wait position, the printing on the recording paper sheet 200 is not performed. The carriage 114 moves in the return direction RD at a prescribed timing, for example, when the printing is finished. In the state where the carriage 114 has returned to the wait position in the side member 106R, the ink heads 120*a*, 120*b* and 120*c* and the washing liquid supply unit 12 mounted on the carriage 114 are located in the side member 106R. The printing position is an example of a first position, and the wait position is an example of a second position.

In the side member 106R, the cleaning unit 118 and the washing liquid tank 14 are located. The cleaning unit 118 is located below the carriage 114 when the carriage 114 is at the wait position.

Figure 2:
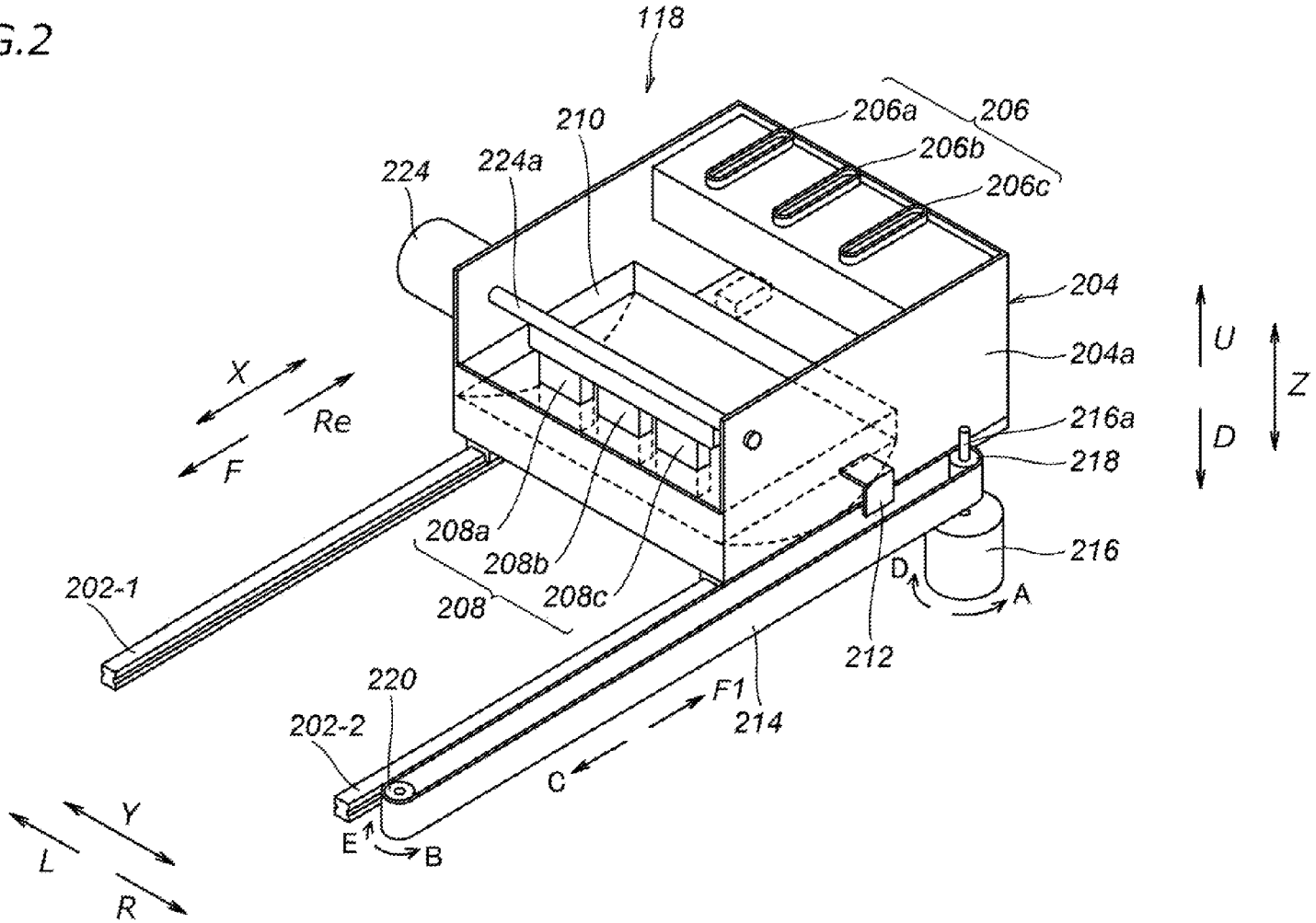
FIG. 2 is an isometric view of a cleaning unit.

As shown in FIG. 2, the cleaning unit 118 includes a cleaning holder 204, a cap portion 206, a wiper portion 208, and a washing liquid tub 210. The cleaning unit 118 preferably is box-shaped. The cleaning unit 118 is movably located on two guide rails 202-1 and 202-2. The guide rails 202-1 and 202-2 extend in the sub scanning direction X in the side member 106R and are parallel to each other. The cap portion 206 is located in a rear portion of the cleaning holder 204. The wiper portion 208 is located in a front portion of the cleaning holder 204. The washing liquid tub 210 is located in the cleaning holder 204 and below the wiper portion 208.

The cap portion 206 includes three caps 206*a*, 206*b* and 206*c*. The cap 206*a* protects the inkjet nozzle 120*n* provided on the bottom surface of the ink head 120*a*. The cap 206*b* protects the inkjet nozzle 120*n* provided on the bottom surface of the ink head 120*b*. The cap 206*c* protects the inkjet nozzle 120*n* provided on the bottom surface of the ink head 120*c*. The caps 206*a*, 206*b* and 206*c* are each connected to a waste liquid tank (not shown) via a tube (not shown). Ink and the washing liquid ejected to the caps 206*a*, 206*b* and 206*c* are discharged to the waste liquid tank.

The wiper portion 208 includes a wiper 208*a* that wipes the bottom surface of the ink head 120*a*, a wiper 208*b* that wipes the bottom surface of the ink head 120*b*, and a wiper 208*c* that wipes the bottom surface of the ink head 120*c*. The wipers 208*a*, 208*b* and 208*c* are fixed to a rotation shaft 224*a*. When the rotation shaft 224*a* rotates, the wipers 208*a*, 208*b* and 208*c* rotate. The rotation shaft 224*a* extends in the main scanning direction Y, and has an axial direction matching the main scanning direction Y. The rotation shaft 224*a* is rotatably attached to a motor 224. When the motor 224 is driven, the wipers 208*a*, 208*b* and 208*c* rotate together with the rotation shaft 224*a*. When located above the rotation shaft 224*a*, the wipers 208*a*, 208*b* and 208*c* respectively contact the ink heads 120*a*, 120*b* and 120*c* and respectively wipe the bottom surfaces of the ink heads 120*a*, 120*b* and 120*c*. When located below the rotation shaft 224*a*, the wipers 208*a*, 208*b* and 208*c* are immersed in the washing liquid stored in the washing liquid tub 210 and are washed by the washing liquid.

An engageable member 212 is provided on a right side wall 204*a* of the cleaning holder 204, and is fixed to a driving belt 214. The driving belt 214 is wound along a pulley 218 fixed to a rotation shaft 216*a* of a motor 216 and a pulley 220 located to the front of the pulley 218. The driving belt 214 is an endless belt and is extended along the pulley 218 and the pulley 220.

When the rotation shaft 216*a* of the motor 216 rotates, the pulley 218 rotates. When the pulley 218 rotates, the driving belt 214 runs. As a result, the cleaning holder 204 fixed to the driving belt 214 via the engageable member 212 moves in the sub scanning direction X on the guide rails 202-1 and 202-2. Specifically, when the rotation shaft 216*a* of the motor 216 rotates in a direction of arrow A, the pulley 220 rotates in a direction of arrow B. Then, the cleaning holder 204 fixed to the driving belt 214 moves forward (see arrow C). When the rotation shaft 216*a* of the motor 216 rotates in a direction of arrow D, the pulley 220 rotates in a direction of arrow E. Then, the cleaning holder 204 fixed to the driving belt 214 moves rearward (see arrow F1). Along with the movement of the cleaning holder 204, the cap portion 206, the wiper portion 208 and the washing liquid tub 210 move in the sub scanning direction X in the side member 106R.

The cleaning holder 204 moves on the guide rails 202-1 and 202-2. The guide rails 202-1 and 202-2 extend in the sub scanning direction X. The carriage 114 moves in the main scanning direction Y. As can be seen, the moving path of the cleaning holder 204 crosses perpendicularly to the moving path of the carriage 114.

The above-described mechanism is merely one example. The mechanism for moving the cleaning holder 204 in the sub scanning direction X is not limited to the above-described mechanism. The cleaning holder 204 does not absolutely need to move in the sub scanning direction X. Another cleaning holder capable of performing capping and wiping without moving in the sub scanning direction X may be used.

Figure 3:
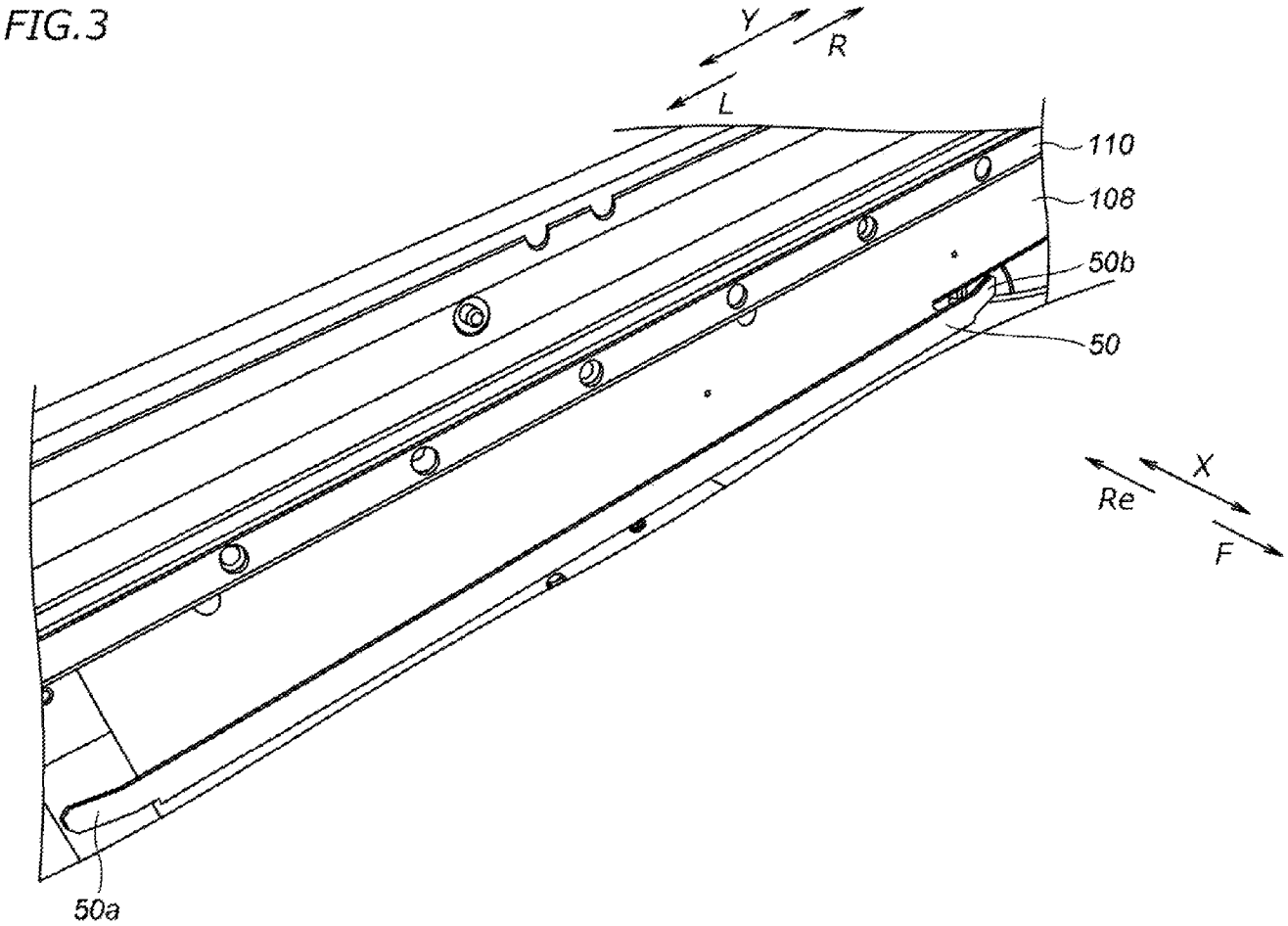
FIG. 3 is an isometric view a dog member.

In an area of the central wall 108 that is in the side member 106R, printing is not performed. As shown in FIG. 3, a dog member 50 is provided on this area of the central wall 108. The dog member 50 is an example of a first contact member, and is provided at a bottom end of the central wall 108. The dog member 50 preferably is separate from the central wall 108 in this preferred embodiment, but may be integral with the central wall 108. The dog member 50 is located to the front of the central wall 108. The dog member 50 is located at such a height as to be contactable with a pivotable member 24 (see FIG. 4*b*) provided in a shutter 20 described later. The dog member 50 includes an inclining portion 50*a* at a left end thereof. The inclining portion 50*a* is inclined so as to extend from a right front position to a left rear position, namely, obliquely leftward and rearward. The inclining portion 50*a* includes an inclining surface inclined rearward with respect to the main scanning direction Y. The dog member 50 also includes an inclining portion 50*b* at a right end thereof. The inclining portion 50*b* is inclined so as to extend from a left front position to a right rear position, namely, obliquely rightward and rearward. The inclining portion 50*b* includes an inclining surface inclined rearward with respect to the main scanning direction Y.

As shown in FIG. 4*a*, the washing liquid supply unit 12 is located in the carriage 114 and is arranged side by side with the ink heads 120*a*, 120*b* and 120*c* in the main scanning direction Y. Although not shown, the washing liquid supply unit 12 is connected to the washing liquid tank 14 (see FIG. 1) via a tube and a pump. The washing liquid stored in the washing liquid tank 14 is supplied to the washing liquid supply unit 12 by the pump. The pump is controlled by a microcomputer (not shown). When the pump is driven, the washing liquid is supplied from the washing liquid tank 14 to the washing liquid supply unit 12 and is stored in the washing liquid supply unit 12. The washing liquid stored in the washing liquid supply unit 12 is ejected from an ejection portion 12*a* of the washing liquid supply unit 12 toward the shutter 20. The washing liquid stored in the washing liquid supply unit 12 is ejected from the ejection portion 12*a* by the control executed by the microcomputer on the pump. The ejection portion 12*a* includes a supply opening, which supplies the washing liquid, located at a tip thereof. The ejection portion 12*a* may be formed of a material which is flexible and resistant against the washing liquid. The ejection portion 12*a* is open downward.

Figure 4B:
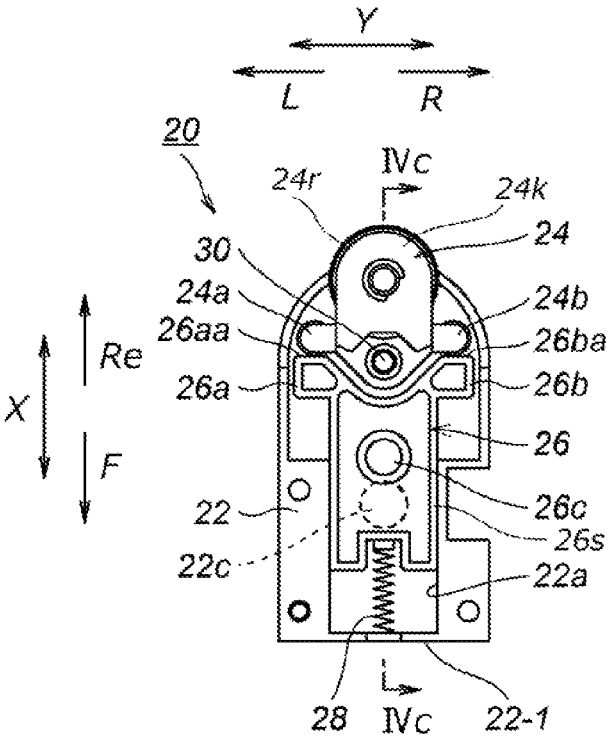
FIG. 4*b* is a plan view of the shutter.
Figure 4C:
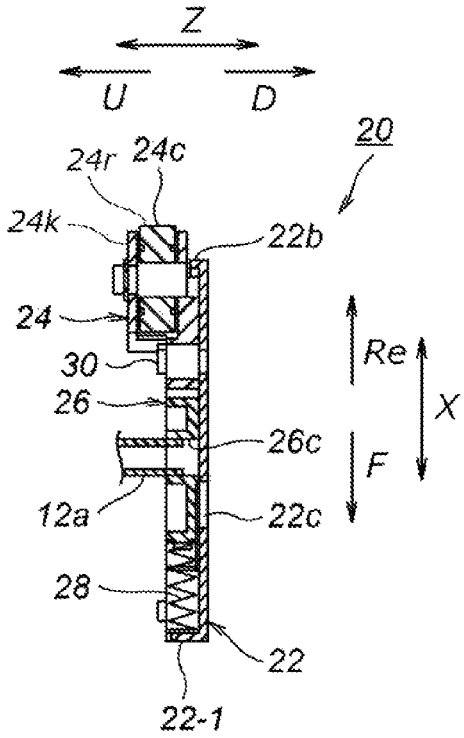
FIG. 4*c* is a cross-sectional view of FIG. 4*b* taken along line IVc-IVc.

The shutter 20 is provided below the washing liquid supply unit 12. As shown in FIG. 4*b* and FIG. 4*c*, the shutter 20 includes a fixed member 22 fixed to the carriage 114, the pivotable member 24 pivotably provided on a rear portion of the fixed member 22, and a movable member 26 provided on the fixed member 22 so as to be movable in the front-rear direction (i.e., in the sub scanning direction X).

As shown in FIG. 4*b*, a rear portion of the fixed member 22 is preferably arc-shaped or substantially arc-shaped. The fixed member 22 includes a guide portion 22*a* that guides the movable member 26. The guide portion 22*a* is located in a top portion of the fixed member 22 and includes a groove extending in the front-rear direction. The guide portion 22*a* extends from a central portion of the fixed member 22 in the front-rear direction to a front portion thereof. The fixed member 22 includes a hole 22*c* running therethrough in the top-bottom direction. The hole 22*c* is an example of a first hole. The hole 22*c* is located in the guide portion 22*a* of the fixed member 22. As described later, the movable member 26 includes a hole 26*c*. The hole 22*c* of the fixed member 22 preferably has the same or substantially the same diameter as that of the hole 26*c* of the movable member 26.

The pivotable member 24 is provided on the rear portion of the fixed member 22. A roller 24*r* is rotatably supported by the pivotable member 24. The roller 24*r* is an example of a second contact member. As shown in FIG. 4*c*, a rear end 24*c* of the roller 24*r* is located to the rear of a rear end 22*b* of the fixed member 22. The pivotable member 24 also includes a pin 30 that pivotably supports a main body 24*k* of the pivotable member 24 to the fixed member 22. The pin 30 is an example of a pivoting shaft. The pivotable member 24 is pivotable about the center of the pin 30. As shown in FIG. 4*b*, the pivotable member 24 includes a protrusion 24*a* in a left front portion thereof, and also includes a protrusion 24*b* in a right front portion thereof. The protrusion 24*a* is located to the left of the pin 30, and the protrusion 24*b* is located to the right of the pin 30. The protrusion 24*a* is an example of a second left contact portion, and the protrusion 24*b* is an example of a second right contact portion.

The roller 24*r* is structured to contact the dog member 50 in the side member 106R. When the carriage 114 moves in the return direction RD, namely, from left to right, the roller 24*r* contacts the left inclining portion 50*a* (see FIG. 3) of the dog member 50. As a result, the pivotable member 24 receives a force from the dog member 50 via the roller 24*r* and thus pivots counterclockwise as seen in the plan view of FIG. 5*a*. In the side member 106R, the carriage 114 is movable to a right end of the guide rail 110. When the carriage 114 moves in the forth direction FD from the right end of the guide rail 110, namely, from right to left, the roller 24*r* contacts the right inclining portion 50*b* of the dog member 50. As a result, the pivotable member 24 receives a force from the dog member 50 via the roller 24*r* and thus pivots clockwise as seen in the plan view of FIG. 5*c*.

The movable member 26 includes a slidable portion 26*s* slidably inserted into the guide portion 22*a* of the fixed member 22. The movable member 26 is structured to be movable in the sub scanning direction X, namely, in the front-rear direction. A protrusion 26*a* is provided obliquely to the left and rear of the slidable portion 26*s*. The protrusion 26*a* is located to the rear of the slidable portion 26*s*. A protrusion 26*b* is provided obliquely to the left and rear of the slidable portion 26*s*. The protrusion 26*b* is located to the rear of the slidable portion 26*s* and to the right of the protrusion 26*a*. The protrusion 26*a* is an example of a first left contact portion, and the protrusion 26*b* is an example of a first right contact portion. The position of a rear end surface 26*aa* of the protrusion 26*a* in the sub scanning direction X, and the position of a rear end surface 26*ba* of the protrusion 26*b* in the sub scanning direction X, match each other. The left protrusion 24*a* of the pivotable member 24 is contactable with the rear end surface 26*aa*. The right protrusion 24*b* of the pivotable member 24 is contactable with the rear end surface 26*ba*.

The movable member 26 includes the hole 26*c* running therethrough in the up-down direction. The hole 26*c* is an example of a second hole. As described above, the hole 26*c* preferably has the same or substantially the same diameter as that of the hole 22*c* provided in the guide portion 22*a* of the fixed member 22. As shown in FIG. 4*c*, the hole 26*c* is in connection with the ejection portion 12*a* of the washing liquid supply unit 12.

The movable member 26 is connected to a spring 28. The spring 28 is provided in the guide portion 22*a* of the fixed member 22. The movable member 26 is constantly urged rearward by the spring 28. In the example shown in FIG. 4*b* and FIG. 4*c*, the spring 28 is located between a front portion 22-1 of the fixed portion 22 and the movable member 26. The spring 28 is connected to the front portion 22-1 of the fixed portion 22 and the movable member 26.

Since the movable member 26 is urged rearward by the spring 28, the left protrusion 26*a* of the movable member 26 and the left protrusion 24*a* of the pivotable member 24 are always in contact with each other, and the right protrusion 26*b* of the movable member 26 and the right protrusion 24*b* of the pivotable member 24 are always in contact with each other. In this state, the hole 26*c* of the movable member 26 is located to the rear of the hole 22*c* of the fixed member 22, and thus the hole 22*c* and the hole 26*c* are not in communication with each other. The hole 26*c* is in connection with the ejection portion 12*a* of the washing liquid supply unit 12. When the hole 26*c* and the hole 22*c* are not in communication with each other, the ejection portion 12*a* is not in communication with the outside of the shutter 20. The ejection portion 12*a* is closed by the shutter 20. In the state where the ejection portion 12*a* is closed by the shutter 20, the washing liquid is not supplied from the washing liquid supply unit 12.

Figure 5A:
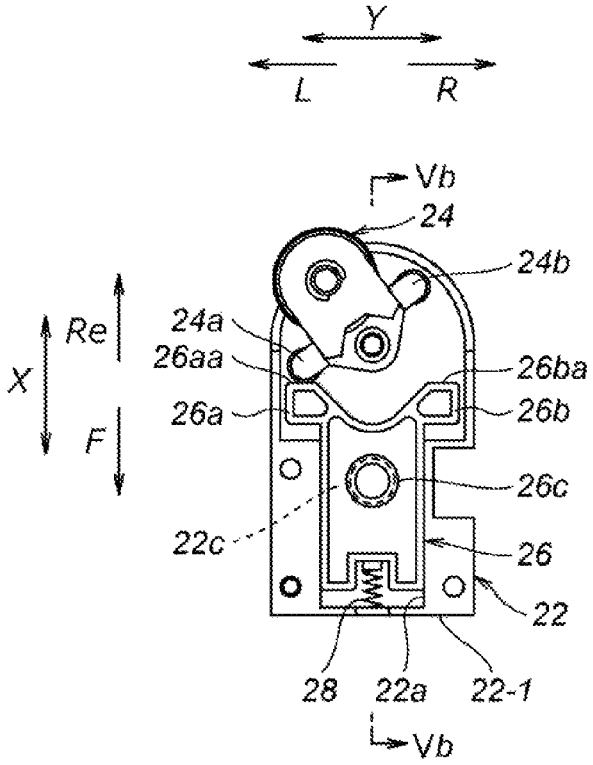
FIG. 5*a* is a plan view of the shutter in a state where a pivotable member is pivoted counterclockwise as seen in a plan view.
Figure 5B:
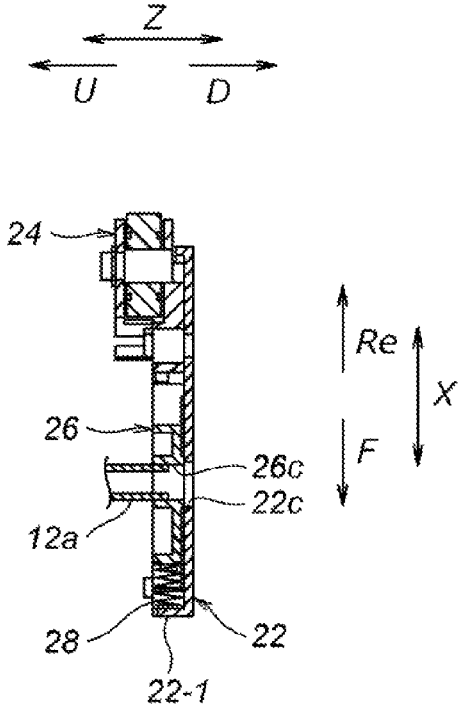
FIG. 5*b* is a cross-sectional view of FIG. 5*b* taken along line Vb-Vb.

As described above, when the carriage 114 moves in the return direction RD in the side member 106R, the pivotable member 24 pivots counterclockwise about the pin 30. As a result, as shown in FIG. 5*a* and FIG. 5*b*, the protrusion 24*a* moves forward, and the protrusion 24*b* moves rearward. At this point, the left protrusion 26*a* of the movable member 26 is pressed forward by the protrusion 24*a*. As a result, the movable member 26 moves forward against the urging force of the spring 28. When the movable member 26 moves forward, the hole 26*c* of the movable member 26 overlaps the hole 22*c* of the fixed member 22. As a result, the hole 22*c* and the hole 26*c* are communicated to each other, and the shutter 20 is opened. As a result, the ejection portion 12*a* connected to the hole 26*c* is communicated to the outside of the shutter 20. In this manner, the counterclockwise pivoting of the pivotable member 24 from the neutral position (shown in FIG. 4*b*) opens the shutter 20, which allows the washing liquid to be supplied from the washing liquid supply unit 12 to the outside of the shutter 20.

Figure 5C:
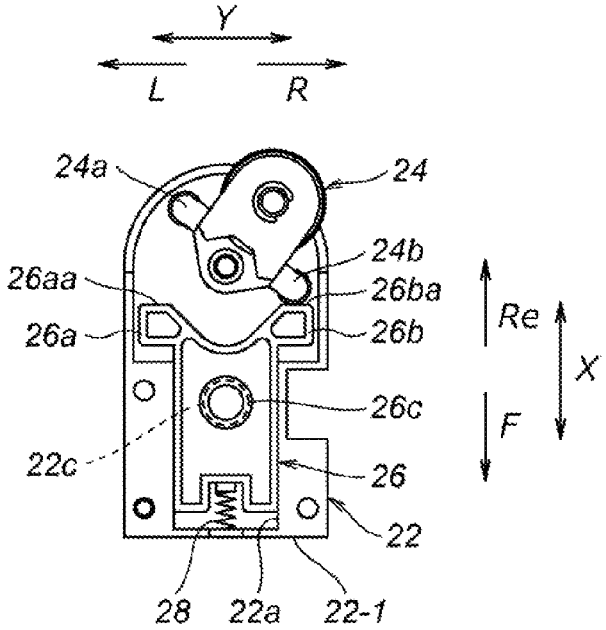
FIG. 5*c* is a plan view of the shutter in a state where the pivotable member is pivoted clockwise as seen in a plan view.

When the carriage 114 moves in the forth direction FD from the right end of the guide rail 110 in the side member 106R, the pivotable member 24 pivots clockwise about the pin 30. As a result, as shown in FIG. 5*c*, the protrusion 24*a* moves rearward, and the protrusion 24*b* moves forward. At this point, the right protrusion 26*b* of the movable member 26 is pressed forward by the protrusion 24*b*. As a result, the movable member 26 moves forward against the urging force of the spring 28. When the movable member 26 moves forward, the hole 26*c* of the movable member 26 overlaps the hole 22*c* of the fixed member 22. As a result, the hole 22*c* and the hole 26*c* are communicated to each other, and the shutter 20 is opened. As a result, the ejection portion 12*a* connected to the hole 26*c* is communicated to the outside of the shutter 20. In this manner, the clockwise pivoting of the pivotable member 24 from the neutral position also opens the shutter 20, which allows the washing liquid to be supplied from the washing liquid supply unit 12 to the outside of the shutter 20.

While the inkjet printer 100 performs printing, the microcomputer (not shown) is programmed to control the movement of the carriage 114 and the ink ejection from the ink head section 116 based on input printing data. While being at the printing position, the carriage 114 moves in the forth direction FD and the return direction RD of the main scanning direction Y. The ink head section 116 ejects ink toward the recording paper sheet 200 moving in the sub scanning direction X.

When the carriage 114 is at the printing position, the pivotable member 24 of the shutter 20 and the dog member 50 do not contact each other. The movable member 26 of the shutter 20 is urged rearward by the spring 28. Therefore, as shown in FIG. 4*b*, the left protrusion 24*a* of the pivotable member 24 and the left protrusion 26*a* of the movable member 26 are in contact with each other, and the right protrusion 24*b* of the pivotable member 24 and the right protrusion 26*b* of the movable member 26 are in contact with each other. Thus, the pivotable member 24 is kept at the neutral position. For this reason, when the carriage 114 is at the printing position, the hole 22*c* of the fixed member 22 and the hole 26*c* of the movable member 26 are not in communication with each other, and the shutter 20 is closed. Then, the washing liquid supply section 12 is closed by the shutter 20. Therefore, even if a vibration is caused by the movement of the carriage 114, the washing liquid stored in the washing liquid supply unit 12 does not leak. As can be seen, when the carriage 114 is at the printing position, the shutter 20 is closed and therefore the washing liquid does not leak outside from the washing liquid supply unit 12. Even if the pump that supplies the washing liquid is inadvertently activated during the printing, the washing liquid is prevented from being supplied during the printing. For these reasons, the washing liquid is prevented from being attached to the recording paper sheet 200, and thus is prevented from adversely influencing the printed sheet.

At a prescribed timing, for example, when the printing is finished, the carriage 114 moves to the wait position in the side member 106R. At this point, the pivotable member 24 of the shutter 20 contacts the dog member 50 provided at the bottom end of the central wall 108 in the side member 106R. As a result, the pivotable member 24 pivots counterclockwise. When the carriage 114 moves in the return direction RD from the printing position, the pivotable member 24 of the shutter 20 contacts the left inclining portion 50*a* of the dog member 50, and pivots counterclockwise. As a result, as shown in FIG. 5*a*, the left protrusion 24*a* of the pivotable member 24 presses forward the left protrusion 26*a* of the movable member 26, and the movable member 26 moves forward. The hole 22*c* of the fixed member 22 and the hole 26*c* of the movable member 26 are communicated to each other, and the shutter 20 is opened. In this manner, the shutter 20 is opened when the carriage 114 is at the wait position. When the carriage 114 is at the wait position, the washing liquid is allowed to be ejected from the ejection portion 12*a* of the washing liquid supply unit 12.

The cleaning unit 118 is movable in the sub scanning direction X in the side member 106R. For supplying the washing liquid, the cleaning unit 118 is located at a prescribed position with respect to the carriage 114 by the movement of the carriage 114 in the main scanning direction Y and/or the movement of the cleaning unit 118 in the sub scanning direction X.

This will be described more specifically. To supply the washing liquid to the cap 206*a*, the cleaning holder 204 is moved in the sub scanning direction X to locate the cap 206*a* on the moving path of the carriage 114. In addition to this, or instead of this, the carriage 114 is moved in the main scanning direction Y to locate the hole 22*c* of the shutter 20 above the cap 206*a*. Then, a prescribed amount of washing liquid is supplied to the cap 206*a* from the ejection portion 12*a* of the washing liquid supply unit 12 via the hole 22*c* of the shutter 20.

For supplying the washing liquid to the cap 206*b*, the cleaning holder 204 is moved in the sub scanning direction X to locate the cap 206*b* on the moving path of the carriage 114. In addition to this, or instead of this, the carriage 114 is moved in the main scanning direction Y to locate the hole 22*c* of the shutter 20 above the cap 206*b*. Then, a prescribed amount of washing liquid is supplied to the cap 206*b* from the ejection portion 12*a* of the washing liquid supply unit 12 via the hole 22*c* of the shutter 20.

For supplying the washing liquid to the cap 206*c*, the cleaning holder 204 is moved in the sub scanning direction X to locate the cap 206*c* on the moving path of the carriage 114. In addition to this, or instead of this, the carriage 114 is moved in the main scanning direction Y to locate the hole 22*c* of the shutter 20 above the cap 206*c*. Then, a prescribed amount of washing liquid is supplied to the cap 206*c* from the ejection portion 12*a* of the washing liquid supply unit 12 via the hole 22*c* of the shutter 20.

The washing liquid supplied to the caps 206*a*, 206*b* and 206*c* is discharged to the waste liquid tank (not shown) after being used to wash the caps 206*a*, 206*b* and 206*c*.

For supplying the washing liquid to the washing liquid tub 210, the cleaning holder 204 is moved in the sub scanning direction X to locate the washing liquid tub 210 on the moving path of the carriage 114. In addition to this, or instead of this, the carriage 114 is moved in the main scanning direction Y to locate the hole 22*c* of the shutter 20 above the washing liquid tub 210. At this point, it is preferable that the hole 22*c* is located to the front of, or the rear of, the rotation shaft 224*a* of the motor 224. Then, a prescribed amount of washing liquid is supplied to the washing liquid tub 210 from the ejection portion 12*a* of the washing liquid supply unit 12 via the hole 22*c* of the shutter 20.

To move the carriage 114 in the forth direction FD, namely, from right to left in the side member 106R, the carriage 114 is once moved in the return direction RD to the right end of the guide rail 110 and then is moved in the forth direction FD. As a result, the pivotable member 24 of the shutter 20 contacts the right inclining portion 50*b* of the dog member 50. As a result, the pivotable member 24 pivots clockwise as shown in FIG. 5*c*. In this state also, the hole 22*c* of the fixed member 22 and the hole 26*c* of the movable member 26 are communicated to each other, and thus the shutter 20 is opened. This allows the washing liquid to be supplied from the ejection portion 12*a* of the washing liquid supply unit 12.

As described above, according to the washing liquid supply mechanism in this preferred embodiment, the washing liquid supply unit 12 is mounted on the carriage 114 together with the ink head section 116. The cap portion 206 and the wiper portion 208 are to be located to face the bottom surface of the ink head section 116. Therefore, the cap portion 206 and the wiper portion 208 are structured to fit below the carriage 114. The structure in which the washing liquid supply unit 12 is mounted on the carriage 114 allows the washing liquid to be supplied to both of the cap portion 206 and the washing liquid supply tub 210 from the same washing liquid supply unit 12. The washing liquid supply mechanism in this preferred embodiment supplies the washing liquid to the cap portion 206 and also supplies the washing liquid to wash the wiper portion 208 to the washing liquid tub 210 that stores the washing liquid. Therefore, the space required for the washing liquid supply mechanism is decreased, and thus the size of the inkjet printer 100 is reduced.

Also according to the washing liquid supply mechanism in this preferred embodiment, the shutter 20 is closed when the carriage 114 is at the printing position. Therefore, the washing liquid is prevented from leaking from the carriage 114 during the printing. Thus, the washing liquid is prevented from adversely influencing the printed sheet.

When the carriage 114 is at the wait position, the shutter 20 is opened and the washing liquid is allowed to be supplied from the washing liquid supply unit 12. The shutter 20 is opened and closed in association with the movement of the carriage 114. The shutter is automatically opened when the carriage 114 is moved from the printing position to the wait position, and is automatically closed when the carriage 114 is moved from the wait position to the printing position. Therefore, the shutter 20 is closed with certainty when the carriage 114 is at the printing position, and is opened with certainty when the carriage 114 is at the wait position.

The shutter 20 is opened by contact of the pivoting member 24 with the dog member 50, and is closed by separation of the pivoting member 24 from the dog member 50. Since the shutter 20 is mechanically opened and closed, there is no need to provide a driving source for opening and closing the shutter 20.

The washing liquid supply mechanism in this preferred embodiment includes the rotatable roller 24*r* as the second contact member to be in contact with the dog member 50. Since the roller 24*r* rotates, the frictional resistance between the roller 24*r* and the dog member 50 is small. This allows the carriage 114 to move smoothly to open and close the shutter 20.

So far, one preferred embodiment of the present invention has been described. The present invention is not limited to the above-described preferred embodiment, and may be carried out in any of various other preferred embodiments. Now, some of such other preferred embodiments will be described.

In the above-described preferred embodiment, the carriage 114 preferably includes three ink heads 120*a*, 120*b* and 120*c* mounted thereon. However, here is no limitation on the number of ink heads mountable on the carriage 114. One or two ink heads, or four or more ink heads, may be mounted, for example.

In the above-described preferred embodiment, the cleaning unit 118 preferably is provided in the side member 106R. However, there is no limitation on the position of the cleaning unit 118. The cleaning unit 118 may be provided in the side member 106L.

In the above-described preferred embodiment, the cap portion 206 and the wiper portion 208 preferably are integrally provided in the cleaning unit 118 accommodated in the side member 106R. The cleaning unit 118 is not limited to having such a structure. The cap portion 206 and the wiper portion 208 may be provided in separate cleaning units. Alternatively, the cap portion 206 and the washing liquid tub 210 may be provided separately.

In the above-described preferred embodiment, the hole 22*c* of the fixed member 22 of the shutter 20 and the hole 26*c* of the movable member 26 of the shutter 20 preferably have the same or substantially the same diameter as each other. The diameter of the hole 22*c* and the diameter of the hole 26*c* may be different from each other. For example, the diameter of the hole 26*c* may be larger than the diameter of the hole 22*c*.

In the above-described preferred embodiment, the movable member 26 preferably moves in the sub scanning direction X, and thus the hole 26*c* of the movable member 26 overlaps the hole 22*c* of the fixed member 22, resulting in opening the shutter 20. However, the shutter 20 is not limited to having such a structure. The shutter 20 may have another structure in which, for example, the shutter 20 is opened by a portion thereof contacting the dog member 50 and is closed by a portion thereof being separated from the dog member 50.

In the above-described preferred embodiment, the dog member 50 preferably is provided in the entirety of the wait position. Alternatively, the dog member 50 may be provided in a portion of the wait position.

In the above-described preferred embodiment, the second contact member preferably is the rotatable roller 24*r*. Alternatively, the second contact member may be a non-rotatable member, or may be a member which does not roll on the dog member 50. The second contact member may be slidable on the dog member 50. The second contact member does not need to be separate from the pivotable member 24 but may be integral with the pivotable member 24.

The above-described preferred embodiment and the other preferred embodiments may be appropriately combined.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A washing liquid supply mechanism provided in an inkjet printer, the inkjet printer including a carriage reciprocally movable in a main scanning direction between a first position at which printing is performed and a second position at which printing is not performed, an ink head including a bottom surface on which a inkjet nozzle is provided, the ink head being mounted on the carriage, a cap structured to fit below the ink head when the carriage is at the second position to protect the ink head nozzle, a wiper structured to fit below the ink head when the carriage is at the second position to wipe the bottom surface of the ink head, and a washing liquid tub that stores a washing liquid usable to wash the wiper and is located below the wiper, wherein the washing liquid supply mechanism supplies the washing liquid to the cap and the washing liquid tub, the washing liquid supply mechanism comprising:

a washing liquid supply device including a supply opening that supplies the washing liquid, the washing liquid supply device being mounted on the carriage;

an openable/closable shutter mounted on the carriage and connected to the supply opening of the washing liquid supply device; and a shutter open/close device that opens the shutter when the carriage moves from the first position to the second position and closes the shutter when the carriage moves from the second position to the first position.

2. A washing liquid supply mechanism according to claim 1, wherein:

the inkjet printer includes a rail member extending in the main scanning direction from the first position to the second position, the rail member being configured to guide the carriage in the main scanning direction;

the shutter open/close device includes a first contact member provided at the second position on the rail member;

the shutter includes a second contact member contacting the first contact member when the carriage is at the second position; and the shutter is structured to open when the first contact member and the second contact member contact each other, and to close when the first contact member and the second contact member are separated from each other.

3. A washing liquid supply mechanism according to claim 2, wherein:

the shutter includes:

a fixed member fixed to the carriage;

a movable member provided on the fixed member so as to be movable in a first direction perpendicular to the main scanning direction and in a second direction opposite to the first direction; and a pivotable member engaged with the movable member and pivotably provided on the fixed member, the pivotable member being pivotable to move the movable member in the first direction; wherein the fixed member includes a first hole;

the movable member includes a second hole overlapping the first hole when the movable member moves in the first direction;

the first contact member includes an inclining surface inclining in the first direction with respect to the first scanning direction; and the second contact member is structured to contact the inclining surface to pivot the pivotable member.

4. A washing liquid supply mechanism according to claim 3, further comprising an urging member provided between the fixed member and the movable member, the urging member being configured to urge the movable member in the second direction.

5. A washing liquid supply mechanism according to claim 4, wherein:

the main scanning direction is a left-right direction, the first direction is a forward or front direction and the second direction is a rearward or rear direction;

the fixed member includes a groove extending in a front-rear direction;

the movable member includes a slidable portion slidably inserted into the groove, a first left contact portion located obliquely to the left and rear of the slidable portion, and a first right contact portion located obliquely to the right and rear of the slidable portion;

the pivotable member includes a pivoting shaft located to the front of the second contact portion and to the rear of the slidable portion, a second left contact portion located to the left of the pivoting shaft and to the rear of the first left contact portion, and a second right contact portion located to the right of the pivoting shaft and to the rear of the first right contact portion;

the pivotable member is structured to be pivotable counterclockwise or clockwise about the pivoting shaft from a neutral position at which the first left contact portion and the second left contact portion contact each other and the first right contact portion and the second right contact portion contact each other; and the washing liquid supply mechanism is structured such that when the pivotable member pivots counterclockwise from the neutral position, the second left contact portion presses forward the first left contact portion to move the movable member forward, resulting in the first hole and the second hole overlapping each other, and such that when the pivotable member pivots clockwise from the neutral position, the second right contact portion presses forward the first right contact portion to move the movable member forward, resulting in the first hole and the second hole overlapping each other.

6. A washing liquid supply mechanism according to claim 5, wherein the first contact member includes a left inclining portion extending obliquely leftward and rearward, a right inclining portion extending obliquely rightward and rearward, and a central portion located between the left inclining portion and the right inclining portion and extending in the left-right direction.

7. A washing liquid supply mechanism according to claim 6, wherein the second contact member includes a roller rotatably supported by the pivotable member.

8. A washing liquid supply mechanism according to claim 1, further comprising:

a cleaning holder that supports the cap, the wiper and the washing liquid tub; and a moving device that moves the cleaning holder in a direction perpendicular to the main scanning direction.

9. An inkjet printer, comprising:

a carriage reciprocally movable in a main scanning direction between a first position at which printing is performed and a second position at which printing is not performed;

an ink head including a bottom surface on which a inkjet nozzle is provided, the ink head being mounted on the carriage;

a cap structured to fit below the ink head when the carriage is at the second position to protect the ink head nozzle;

a wiper structured to fit below the ink head when the carriage is at the second position to wipe the bottom surface of the ink head; and a washing liquid tub located below the wiper and configured to store a washing liquid usable to wash the wiper; and a washing liquid supply mechanism that supplies the washing liquid to the cap and the washing liquid tub; wherein the washing liquid supply mechanism includes:

a washing liquid supply device including a supply opening to supply the washing liquid, the washing liquid supply device being mounted on the carriage;

an openable/closable shutter mounted on the carriage and connected to the supply opening of the washing liquid supply device; and a shutter open/close device that opens the shutter when the carriage moves from the first position to the second position and closes the shutter when the carriage moves from the second position to the first position.

* * * * *